United States Patent [19]

Tanaka et al.

[11] 4,293,227

[45] Oct. 6, 1981

[54] SPRAYING UNIT FOR UNHARDENED CONCRETE AND THE LIKE

[75] Inventors: Katsushi Tanaka, Takarazuka; Taro Okamoto, Miki, both of Japan

[73] Assignee: Kyokuto Kaihatsu Kogyo Co., Ltd., Nishinomiya, Japan

[21] Appl. No.: 74,805

[22] Filed: Sep. 11, 1979

[30] Foreign Application Priority Data

Oct. 2, 1978 [JP] Japan ..... 53-121711

[51] Int. Cl.[3] ..... B28C 5/46

[52] U.S. Cl. ..... 366/11; 239/304

[58] Field of Search ..... 366/5, 11, 38, 50, 64, 366/67; 239/304

[56] References Cited

U.S. PATENT DOCUMENTS 1,731,953 10/1929 Thomson ..... 366/5

3,840,186 10/1974 Broadfoot ..... 241/15

4,046,357 9/1977 Twitchell ..... 239/304 X

*Primary Examiner*—Robert L. Bleutge

*Attorney, Agent, or Firm*—Wenderoth, Lind & Ponack

[57] ABSTRACT

The present invention relates to a spraying unit for unhardened concrete and the like, which is provided with an apparatus capable of mixing a constant quantity of quick-set additive, for example, into unhardened concrete to be sprayed.

The apparatus capable of mixing the constant quantity of quick-set additive into unhardened concrete and the like is adapted to usually carry and supply the constant volumetric weight and quantity of quick-set additive outside a quick-set additive container regardless of the amount of the quick-set additive stored inside the container.

6 Claims, 6 Drawing Figures

SPRAYING UNIT FOR UNHARDENED CONCRETE AND THE LIKE

BACKGROUND OF THE INVENTION

The present invention relates to a spraying apparatus for unhardened concrete, etc. and more particularly, to an apparatus provided with means for mixing quick-set additives for rapid bonding agents with the unhardened concrete.

Up to the present, there have been proposed a number of process-methods each comprising the steps of mixing quick-set additive with the unhardened concrete and subsequently spraying the mixture. However, it is well known in the art that the effective accomplishment of the step of uniformly mixing the quick-set additive with the unhardened concrete by a simple procedure is extremely difficult, thus, most conventional process-methods of homogenizing the density throughout a substance produce unsatisfactory results when applied to an apparatus for mixing quick-set additives with unhardened concrete.

More specifically, according to a typical apparatus for feeding the quick-set additive by constant amount, there has been conventionally provided a screw conveyer in the lower portion of a particulate quick-set additive container so that the particulate matter located in the lower portion inside the container may be carried to a predetermined place outside the container. However, the particulate matter which lies relatively low inside the container, i.e., the particulate matter stored in the lower layer inside the container, is naturally compressed by the weight of the particulate matter lying relatively high inside the container, which results in the portion lying low inside the container becoming higher in density than that lying high. Particularly, when the container is substantially filled with the particulate matter, the particulate matter in the lower layer becomes greater in density through being compressed by the weight of a large amount of particulate matter in the upper layer. Alternatively, when the stored particulate matter is reduced in amount, due to the discharging operation of the particulate matter, the weight of the particulate matter located in the upper layer is gradually reduced, thus resulting in a gradual decrease in the density of the particulate matter in the lower layer. Since the particulate matter in the lower layer to be carried by the screw conveyer is varied in density depending upon the stored amount of particulate matter inside the container as described above, the density is varied if the particulate matter of the apparently constant amount is carried by the screw conveyer, whereby it has been quite difficult to discharge the particulate matter of the constant quantity and further, it cannot be expected that the predetermined quantity of the quick-set additive is mixed into the unhardened concrete.

SUMMARY OF THE INVENTION

Accordingly, an essential object of the present invention is to provide a spraying unit for unhardened concrete and the like, which is provided with an apparatus capable of mixing the constant quantity of particulate matter into unhardened concrete, etc.

Another important object of the present invention is to provide a spraying unit for unhardened concrete and the like of the above-described type, wherein an apparatus capable of mixing the constant quantity of particulate matter into unhardened concrete and the like is adapted to usually carry and supply the constant volumetric weight and quantity of particulate matter outside a particulate matter container regardless of stored amount of the particulate matter inside the container.

A further object of the present invention is to provide a spraying unit for unhardened concrete and the like of the above-described type, wherein an apparatus capable of mixing the constant quantity of particulate matter with unhardened concrete and the like is specifically adapted to be used with a spraying apparatus for unhardened concrete, etc. so that the constant quantity of quick-set additive may be constantly mixed into the unhardened concrete.

A still further object of the present invention is to provide a spraying unit for unhardened concrete and the like of the above-described type, which is simple in construction and, is highly efficient in use.

In accomplishing these and other objects according to one preferred embodiment of the present invention, there is provided a spraying unit for unhardened concrete and the like which is substantially comprised of an unhardened concrete supply apparatus and an apparatus capable of mixing the constant quantity of particulate matter, i.e., a quick-set additive, into the unhardened concrete.

The unhardened concrete supply apparatus itself is a conventional type, and comprises a concrete pump, a hopper connected to an inlet port of the concrete pump, and an injection means, which is connected through a flexible conduit to a discharge port of the concrete pump.

The apparatus capable of mixing the constant quantity of particulate matter into the unhardened concrete according to the present invention comprises a particulate matter container, a particulate matter scooping device, a constant quantity conveying device, and a pneumatic conveying means. The particulate matter scooping device mentioned above comprises a rotary shaft, which is rotatably supported at both ends by the particulate matter container, while extended through a central portion of the container mentioned above; a plurality of arms, one end of each is secured to the rotary shaft while the other end thereof is extended in a radial direction with respect to the rotary shaft; scooping members, each respectively secured to the tip end portions of the arm, which are respectively bent so as to be parallel with the rotary shaft; and a guiding member supported on one side in an upper portion inside the container so as to guide the particulate matter, which has been scooped by the scooping members rotary shaft, without dropping the particulate matter on the way to the constant quantity conveying device. The constant quantity conveying device comprises a carrying passage which is horizontally provided in the position above the rotary shaft inside the container while rendering a parallel relationship with the rotary shaft and is mounted, in a cantilever manner, on one side wall of the container, a screw axially extended through the passage, and a prime mover for driving the screw. More specifically, the carrying passage is composed of a carrying tube and a carrying trough whose tip end is U-shaped in section so as to form a carrying-in opening of the particulate matter having been carried by the particulate matter scooping device. The base portion of the carrying tube is cylindrical in shape and is secured to the side wall of the container, while a carrying-out opening which opens outside the container is opened on the base end of the carrying tube. Furthermore, the carrying tube has a collar substantially upwardly projected from a connecting end portion with the carrying trough. The pneumatic conveying means comprises a housing fixedly attached to the base portion of the carrying passage and constituting an air chamber communicated with the outlet opening, an air compressor, a conduit, a communicating pipe, and a supply pipe. More specifically, in the housing, a flow-inlet port and a flow-outlet port each communicate with the air chamber, wherein the flow-inlet port is communicated with the air compressor through a conduit, while the flow-outlet port is communicated with an injection means through the supply pipe. Moreover, the air chamber is communicated, through a communicating pipe, with an upper portion of the particulate matter container so that the pressure in the air chamber is equalize with that of the particulate matter container.

By the arrangement mentioned above, in accordance with rotation of the rotary shaft and scooping members in a predetermined direction, the particulate matter stored within the container is scooped up by the scooping members and is thrown onto the carrying-in or supply opening of the carrying through. Subsequently, upon rotation of the screw by the prime mover, the particulate matter placed onto the carrying through inlet opening is transported and fed into the air chamber through the carrying-pipe. Accordingly, the particulate matter is homogenized, thus having a uniform and constant density throughout and is thrown into the carrying trough and fed into the air chamber while maintaining a uniform constant quantity and density because of the operative cooperation between the carrying passage and the screw. Therefore, particulate matter having a substantially constant volumetric density is fed into the air chamber and is successively fed to the injection means together with the air. Both are fed under a compressed pressure condition.

BRIEF DESCRIPTION OF THE DRAWINGS

These and other object and features of the present invention will become apparent from the following description when taken in conjunction with the preferred embodiment which is referenced to the accompanying drawings in which.

Before the description of the present invention proceeds, it is to be noted that like parts are designated by like reference numerals throughout the several views of the accompanying drawings, unless otherwise so indicated.

DETAILED DESCRIPTION OF THE INVENTION

Figure 1:
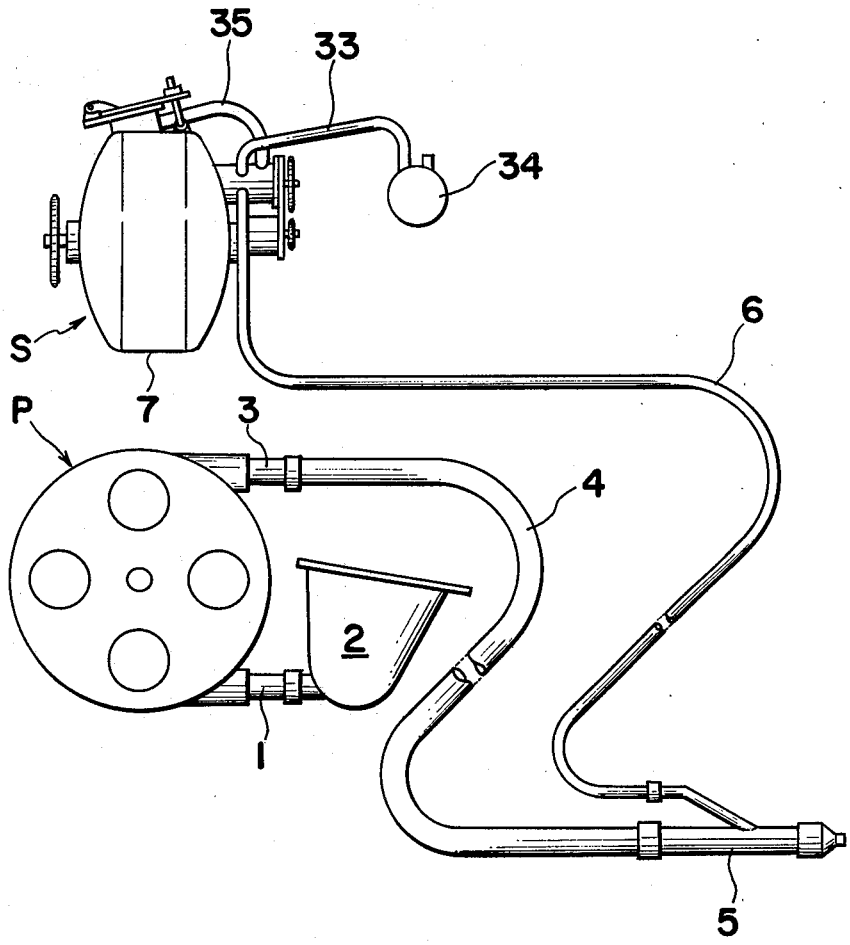
FIG. 1 is a perspective view of an unhardened concrete supply apparatus in conjunction with an apparatus capable of mixing a constant quantity of particulate matter with unhardened concrete according to the present invention.

Referring now to FIG. 1, there is shown an unhardened concrete supply apparatus in conjunction with the present invention, in which an apparatus S capable of mixing the constant quantity of particulate matter with unhardened concrete according to the present invention, is specifically arranged to be used with a spraying apparatus for unhardened concrete so that the constant quantity of quick-set additive may be constantly mixed with the unhardened concrete. The unhardened concrete supply apparatus itself is a conventional type and comprises a concrete pump P of the conventionally known throttle type, a hopper 2 connected to an inlet port 1 of the concrete pump P, and an injection gun 5 which is connected through a flexible conduit 4 to a discharge port 3 of the concrete pump P. A flexible supply pipe 6 is communicated, at one end, with the injection gun 5, while the other end communicates with the apparatus S. Therefore, as described above, in this embodiment, quick-set additives are employed as the particulate matter.

The unhardened concrete accommodated inside the hopper 2 is fed through the conduit 4 to the injection gun 5 by the driving operation of the concrete pump P, with a predetermined quantity of quick-set additive being simultaneously fed under pressure to the injection gun 5 from the apparatus S. During an introducing operation, the unhardened concrete is mixed with the quick-set additive and jetted from the injection gun 5, and then subsequently the mixture is sprayed against a wall face or the like.

Figure 2:
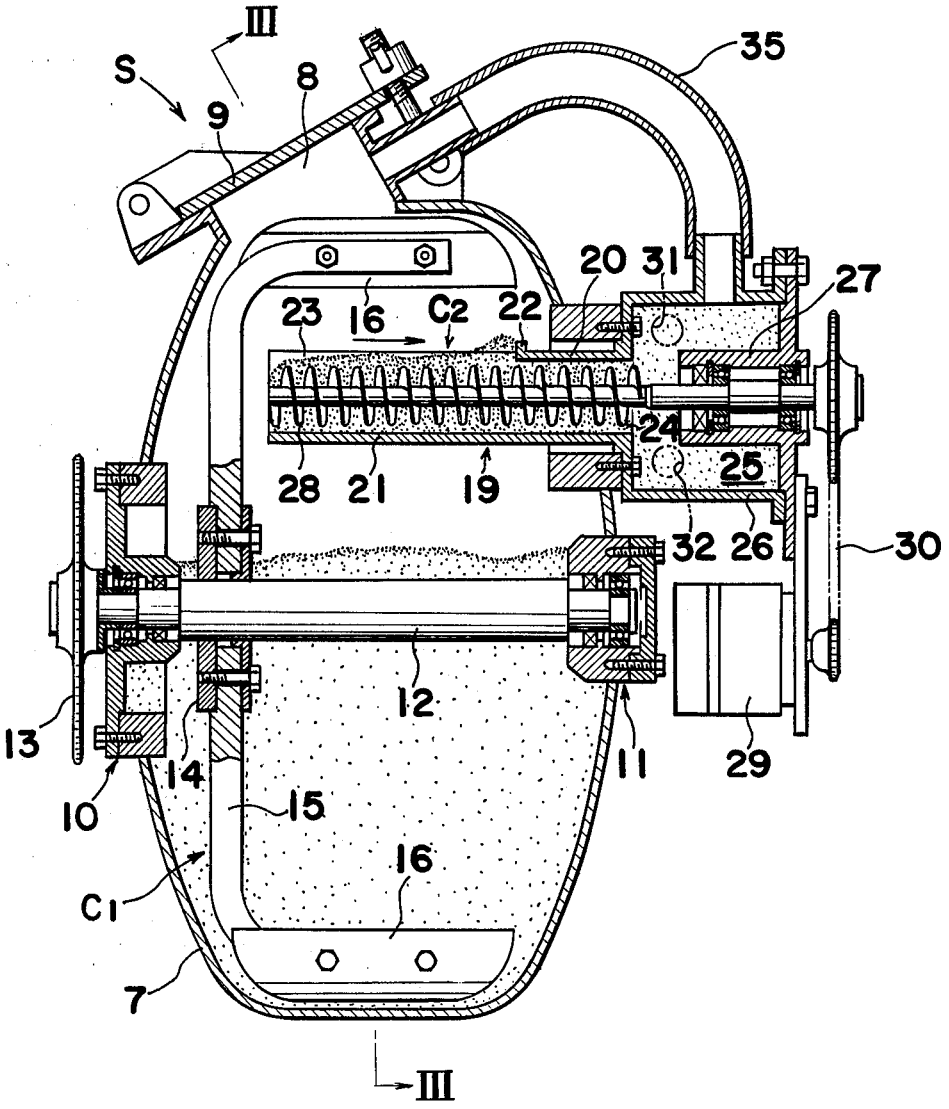
FIG. 2 is a side section view of one preferred embodiment of an apparatus capable of mixing the constant quantity of particulate matter with unhardened concrete and the like according to the present invention.
Figure 3:
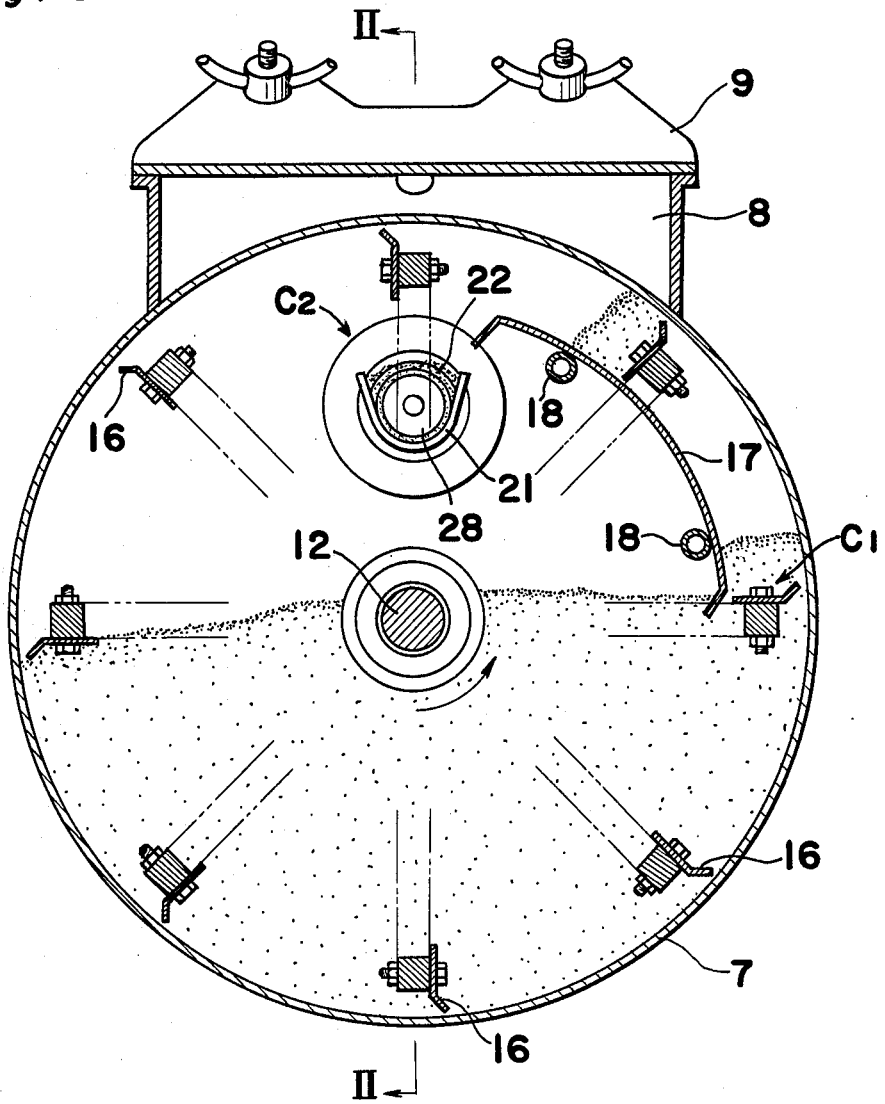
FIG. 3 is a section view taken along the line III—III of FIG. 2.

Referring now to FIGS. 1, 2, and 3, there is shown a detail of the apparatus capable of mixing the constant quantity of particulate matter with unhardened concrete, or more specifically, an apparatus capable of mixing substantially constant volumetric weight and volumetric amount of particulate matter with unhardened concrete, according to the present invention. The apparatus S, according to the present invention, comprises a particulate matter container 7, a particulate matter scooping device $C_1$, a constant quantity conveying device $C_2$, and a pneumatic conveying means which includes an air compressor 34, and a supply pipe 6.

With regard to the particulate matter container 7, the container 7 is of a closed type and is cylindrical in shape. An inlet opening 8 is positioned on a top surface of the container 7. The inlet opening 8 is selectively opened and closed by a cover 9, in which one end is pivotally supported on the periphery of the container 7. A rotary shaft 12 is rotatably supported at its both ends through bearing blocks 10 and 11, while extended through a central portion of the particulate matter container 7.

With regard to the particulate matter scooping device $C_1$, the device $C_1$ substantially comprises the rotary shaft 12, a plurality of arms 15, scooping plates 16 and a guiding member 17. More specifically, inside the particulate matter container 7, a plurality of arms 15 are secured with radial directions in respect to the rotary shaft 12, through supplementary securing members 14 to the rotary shaft 12. Each of the arms 15 is bent at its tip end portion, at approximately a right angle with respect to the substantially vertical direction. Each scooping member 16 is secured to one of the tip end portions of the bent portions of the arms. Furthermore, the respective scooping members 16 are arranged to be spacedly positioned with respect to a cylindrical inner peripheral surface of the particulate matter container, with the respective outer periphery of the members 16 being, located very close to the inner peripheral surface mentioned above. With the arrangement as mentioned above, upon counterclockwise rotation of the rotary shaft 12 as specifically shown in FIG. 3, the plurality of arms 15 are simultaneously rotated, whereby the scooping members 16 installed on the tip end portions of 15 are adapted to scoop up the particulate matter stored within the container 7 and to throw the particulate matter into a carrying-in or supply opening 23 of the constant quantity conveying device $C_2$, which will be specifically described later. As is specifically shown in FIG. 3, on one side in the upper portion inside the particulate matter container 7, the circular guiding plate 17, located around a shaft center of the rotary shaft 12, is supported by support pipes 18. The guide plate 17 is adapted to guide the particulate matter, which has been scooped up by the scooping members 16, to the constant quantity conveying device $C_2$, to be described later, without dropping the particulate matter on the way to the device $C_2$.

With regard to the constant quantity conveying device $C_2$, the conveying device $C_2$ substantially comprises a carrying passage 19, a screw 28 extending axially through the carrying passage 19, and a prime mover 29 (FIG. 6) for driving the screw 28. More specifically, in the position above the rotary shaft 12 inside the container, the carrying passage 19 is horizontally positioned, in parallel with the rotary shaft 12, and is mounted, in a cantilever manner, on one side wall of the particulate matter container 7. The carrying passage 19 is composed of a carrying tube or a pipe 20 with a base portion that is cylindrical in shape and a carrying trough 21 with a tip end that is U-shaped in section. The carrying pipe 20 has a collar 22 substantially upwardly projected from a connecting end portion with the carrying trough 21. Still referring to FIG. 2, the carrying pipe 20 is supported on one side wall of the particulate matter container 7. Also, the carrying trough 21 extends into the container 7. The carrying-in or supply opening 23 is opened on a top face of the carrying trough 21, while an outlet opening 24, which opens outside the container 7, is opened on the base end of the carrying pipe 20. A housing 26, which constitutes an air chamber 25 communicated with the carrying-out opening 24, is fixedly attached to the base portion of the carrying passage 19. The base end of the screw 28 is rotatably supported on a bearing block 27 provided in the housing, while the screw 28 is supported in a cantilever manner at one end portion, with a substantial screw-portion being axially extended through the carrying passage 19. The prime mover 29 is spacedly provided with respect to the container 7, and more particularly, is suspended from the housing 26. A motive shaft of the prime mover 29 operatively cooperates with the screw 28 through a reduction transmission mechanism 30. In the housing 26, a flow-inlet port 31 and a flow-outlet port 32 are each respectively communicated with the air chamber 25 and are opened. The flow-inlet port 31 is communicated with the air compressor 34 through a conduit 33, and the flow-outlet port 32 is communicated with the injection gun 5 through the supply pipe 6. Moreover, the air chamber 25 is directly communicated, through a communicating pipe 35, with an upper portion of the particulate matter container 7, so that the pressure may equalize in the particulate matter container 7 and the air chamber 25, resulting in the pressure inside the constant quantity conveying device $C_2$ remaining substantially constant or, not substantially fluctuating.

As is clear from the aforementioned description, the pneumatic conveying means comprises the air compressor 34, the conduit 33, the air chamber 25, the communicating pipe 35, and the supply pipe 6.

Now the functional characteristics of the above-described embodiment of the present invention are described in detail. Upon activation of the concrete pump P, the unhardened concrete stored inside the hopper 2 is fed to the injection gun 5 through the conduit 4, while, at the same time, the compressor 34 is driven so as to make the compressed air flow into the air chamber 25 through the flow-inlet port 31 from the conduit 33, so as to forcibly feed the compressed air inside the chamber 25 into the injection gun 5 through the supply pipe 6 from the flow-outlet port 32 accordingly. Such being the case as mentioned above, the constant quantity of particulate matter, i.e., quick-set additive which has been carried into the air chamber 25, by the apparatus S is forcibly fed under the compressed air pressure to the injection gun 5, via supply pipe 6, is mixed with the unhardened concrete inside the injection gun 5, and is subsequently jetted from the injection gun 5. The details of feeding the constant quantity of particulate matter, i.e., quick-set additive into the air chamber 25 are as follows. In accordance with counterclockwise rotation of the rotary shaft 12 the scooping members 16, which are respectively attached to the tip-ends of the plurality of arms 15, as shown in FIG. 2, scoop the quick-set additive stored within the particulate matter container 7 and throw it onto the carrying-in or supply opening 23 of the carrying passage 19. Upon rotation of the screw 28 by the prime mover 29, the quick-set additive placed inside the carrying passage 19 is carried in the direction as shown by an arrow in FIG. 2 into the air chamber 25 through the carrying-out opening 24. Accordingly, the quick-set additive having been thus homogenized in an approximately constant density or an approximately specifically constant volumetric density, due to a reason to be mentioned hereinbelow, is thrown into the carrying passage 19 and is fed into the air chamber 25, while remaining constant density because of the operative cooperation between the carrying passage 19 and the screw 28. More specifically, the quick-set additive stored within the particulate matter container has a respective density-distribution which depends on the stored amount of the quick-set additive positioned above it. Thus, respective local specific densities vary depending upon the respective depth of a given additive with respect to a substantially horizontal reference level. However, the quick-set additive scooped by the scooping members 16 is relieved from the weight of the quick-set additive stored thereabove and gravitationally dropped when the quick-set additive is thrown into the carrying passage 19 from the scooping members 16, the quick-set additive is homogenized to be of approximately constant density when it is thrown into the carrying passage 19. And if the screw 28 is driven when the quick-set additive of approximately constant volumetric density placed within the carrying trough 21 of the carrying passage 19, the quick-set additive is carried in the direction as denoted by the arrow in FIG. 2. Furthermore, at this time, the quick-set additive improperly thrown is arranged to be caught through the existence of the collar 22. In addition, if the screw 28 is driven, when the trough 21 is filled to capacity, the excess scooped additive is collected and piled before the collar 22, which is attached to the end of carrying pipe 20. This excessive additive ensures the carrying pipe 20 will operate under a fully loaded condition, thus further ensuring that the additive conveyed to the chamber 25 is of an approximately constant density and quantity. Therefore, according to the aforementioned arrangement as described above, the present invention ensures that a constant quantity of quick-set additive is normally fed into the air chamber 25 and is forcibly fed to the injection gun 5 together with the air under a compressed pressure condition.

Figure 4:
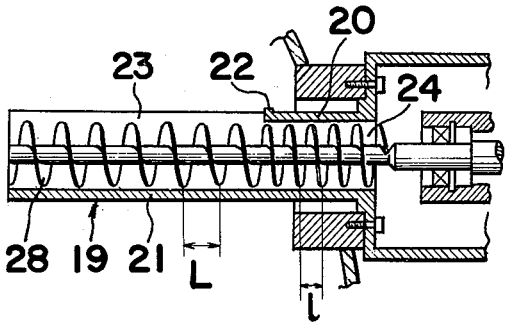
FIG. 4 is a side section view showing the construction of one modified embodiment of a constant quantity conveying device to be employed in the apparatus of FIG. 2.

Referring now to FIG. 4, there is shown one modified embodiment of the constant quantity conveying device $C_2$ according to the present invention. In this modified embodiment, a pitch (l) of the screw 28 located in the carrying pipe 20 is arranged to be smaller than a pitch (L) of the screw 28 located in the carrying trough 21. By this arrangement, even if the thrown amount of the quick-set additive thrown into the carrying trough 21 becomes small, the constant specific weight or a constant density of particulate matter, can always be carried into the air chamber 25. More specifically, since the carrying capacity of the screw 28 is arranged to be smaller in the carrying pipe 20 than in the carrying trough 21, the quick-set additive fed into the carrying trough 21 is jammed and is delayed in forward flowing operation immediately before the carrying pipe 20, even if the absolute amount of quick-set additive thrown onto the carrying trough 21 is substantially small. Therefore, even if the supply amount of the quick-set additive to the carrying trough 21 is small, a constant quantity of the quick-set additive can be normally fed into the air chamber 25.

Figure 5:
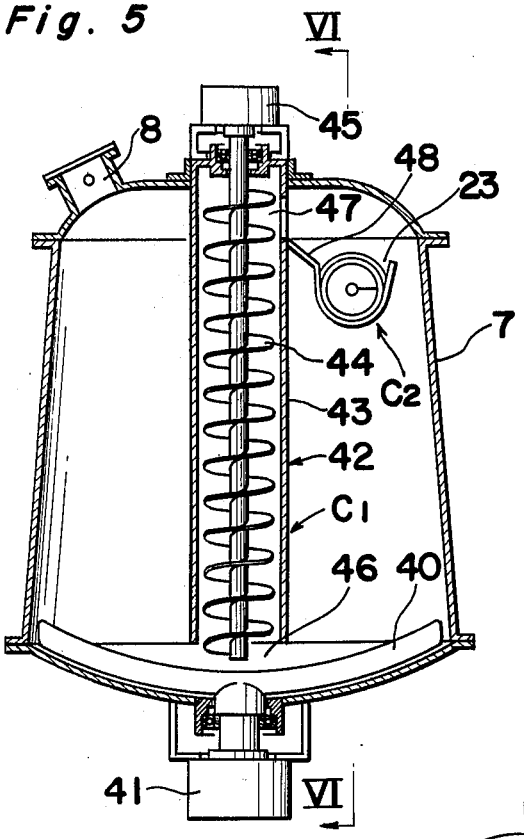
FIG. 5 is a view similar to FIG. 1, but particularly shows a modified embodiment of the apparatus of FIG. 2.
Figure 6:
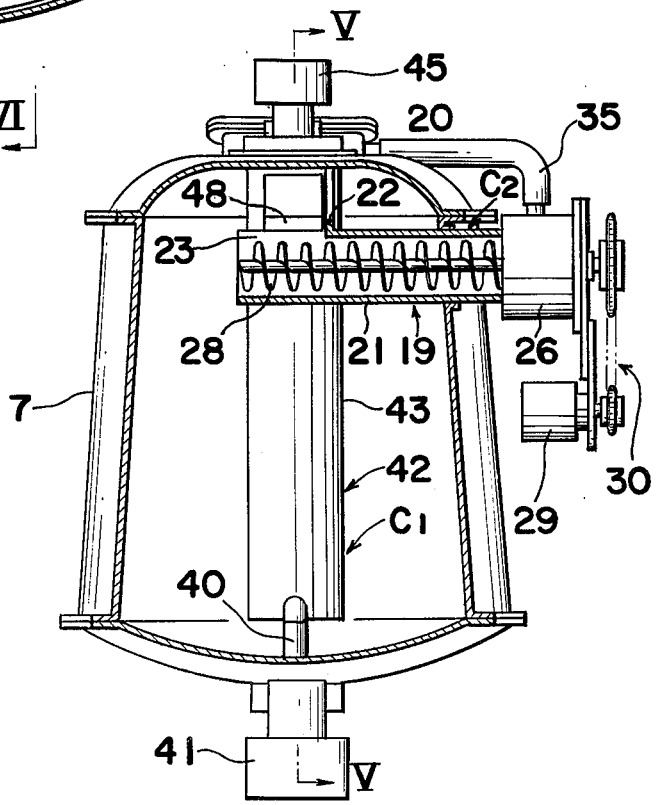
FIG. 6 is a section view taken along the line VI—VI of FIG. 5.

Referring now to FIGS. 5 and 6, there is shown a further modified embodiment according to the present invention, wherein this embodiment is different from those previously described in respect to the construction of the particulate matter scooping device $C_1$ for the particulate matter and in respect to the arrangement of the constant quantity conveying device $C_2$ for the particulate matter. More specifically, a stirring blade 40, which is arranged to be rotatable a substantially horizontal direction, is provided on the inner bottom portion of the particulate matter container 7. The stirring blade 40 operates cooperatively with a prime mover 41 provided on the conical bottom wall of the particulate matter container 7. A vertical screw conveyer 42 is provided in the central portion inside the particulate matter container 7. The vertical screw conveyer 42 comprises a vertical carrying pipe 43 and a screw 44 extending vertically longitudinally through the carrying pipe 43. The screw 44 is attached to prime mover 45 which is supported by the top wall of the particulate matter container 7. The vertical carrying pipe 43 has an inlet opening 46 at its lower portion and an outlet opening 47 at its upper portion. The constant quantity conveying device $C_2$ is located on the side of the particulate matter container 7 so as to cooperate effectively with the vertical screw conveyer 42. The carrying-in opening 23 communicates, with the outlet opening 47 of the vertical screw conveyer 42 by a shoot 48.

The operational characteristics of this modified embodiment are as follows. When the stirring blade 40 is rotated through the driving operation of the prime mover 41, the quick-set additive is stirred, whereby not only the bridge phenomenon or the aggregating phenomenon of quick-set additive is prevented, but also the quick-set additive is effectively guided to a central portion inside the particulate matter container 7. Also, when the vertical screw conveyer 42 is driven through the driving operation of the prime mover 45, the quick-set additive is carried upwardly, by the screw conveyer 42, fed to the constant quantity conveying device $C_2$ through the shoot 48 from the outlet opening 47. The quick-set additive carried during this carrying period is set free from the weight of the stored quick-set additive or the weight of the quick-set additive storing thereabove and is mixedly thrown about and homogenized in density. Also, according to this embodiment, the amount carried by the vertical screw conveyer 42 is greater than the carrying capacity of the constant quantity conveying device $C_2$.

According to the present invention as described hereinabove, the particulate matter is carried to the constant quantity conveying device $C_2$ while being homogenized in constant volumetric density with the help of the particulate matter scooping device $C_1$ regardless of the stored amount of the particulate stored within the particulate matter container. Successively, by the operation of the conveying device $C_2$, the particulate matter of a constant volumetric density is transported while maintaining a constant density. Thus, particulate matter of a constant weight and volume or particulate matter of a desired density constant specific amount can be always fed from the particulate matter container to a supply location.

Also, the particulate matter container is formed with a closed type vessel and the air chamber is provided in connection with the outlet opening of the constant quantity conveying device $C_2$. Since the air chamber is directly communicated with the particulate matter container so that the particulate matter may be fed to the proper supply location from the air chamber, the pressure inside the particulate matter container equalizes with that inside the air chamber, whereby the particulate matter discharged from the constant quantity conveying device $C_2$ is carried more stably and effectively than if the air was supplied to the constant quantity conveying device $C_2$.

Although the present invention has been fully described by way of example with reference to the figures, it is to be noted here that various changes and modifications are apparent to those skilled in the art. Therefore, since such changes and modifications do not depart from the scope of the present invention, they should be construed as included within the subject matter herein.

What is claimed is:

1. A spraying unit for spraying a mixture of unhardened concrete and a quick-set particulate concrete additive, said unit comprising:

an injection gun having a first and second inlet and an outlet for spraying a mixture of unhardened concrete and particulate additive;

an unhardened concrete supply apparatus having a motor, and a pump, powered by said motor for pumping unhardened concrete, wherein said pump has an inlet for receiving unhardened concrete and an outlet communicating with said first injection gun inlet and for supplying unhardened concrete to said injection gun; and an apparatus for providing a particulate additive at a substantially consistent density and under a positive pressure to said injection gun, said additive apparatus including:

a pneumatic conveying means having an air compressor and a chamber, wherein said chamber has an inlet port for receiving a particulate additive of a substantially consistent density, and air inlet port for receiving compressed air from said compressor, and an outlet port communicating with said second injection gun inlet, whereby, when said chamber receives compressed air and a particulate additive at a substantially consistent density, said means conveys a mixture of particulate additive, at a substantially consistent density, and compressed air to said injection gun;

a particulate additive container for holding a supply of particulate additive;

a second particulate transporting device in said container and having an inlet for receiving a first maximum volume rate of particulate additive, a screw conveyer means for conveying particulate additive of a substantially consistent density and at a second maximum volume rate, which is less than said first maximum volume rate, and an outlet opening communicating with said first chamber inlet port exteriorly of said container and for discharging particulate additive from said conveyor means to said pneumatic conveying means; and a first particulate transporting device in said container for transporting particulate additive from a lower portion of said container, and for depositing the same at said first maximum volume rate and at a substantially consistent density to said second device inlet.

2. A spraying unit as claimed in claim 1, wherein:

said container is substantially hermetical and has a communication means extending therefrom and into said chamber for directly communicating the interior of said container with the interior of said chamber;

said second device is located in an upper portion of said container and has a substantially horizontal carrying passage for accomodating said screw conveyer means; and said second device inlet includes an open top supply opening for receiving particulate additive.

3. A spraying unit as claimed in claim 2, wherein:

said carrying passage includes a open top carrying trough and a carrying pipe, said carrying pipe having two ends which communicate with said second device outlet opening and said open top carrying trough respectively, and said open top carrying trough having an end which communicates with said open top supply opening and for receiving particulate additive at said first maximum volume rate; and said carrying pipe includes an upwardly projecting collar adjacent to said carrying trough for catching particulate additive.

4. A spraying unit as claimed in claim 3, wherein said first device includes:

a substantially horizontal rotary shaft powered by a prime mover;

a plurality of arms connected to and radially extending from said rotary shaft; and scooping plates installed on each of the outwardly extending tip portions of said arms and for scooping particulate additive from a lower portion of said container and depositing the same at said second device supply opening.

5. A spraying unit as claimed in claim 3, wherein said first device includes:

a substantially vertical carrying pipe with an inlet opening at the lower portion thereof and an outlet opening at the upper portion thereof; and a vertical screw conveyer accomodated within said vertical carrying pipe and for conveying particulate additive from a lower portion of said container to said second device supply opening.

6. A spraying unit as claimed in claim 1, wherein said container is substantially hermetical and has a communication means for directly communicating the upper interior portion of said container with the interior of said chamber.

* * * * *